US005274836A

United States Patent [19]

Lux

[11] Patent Number: 5,274,836

[45] Date of Patent: Dec. 28, 1993

[54] MULTIPLE ENCODED CARRIER DATA LINK

[75] Inventor: Paul A. Lux, Poway, Calif.

[73] Assignee: GDE Systems, Inc., San Diego, Calif.

[21] Appl. No.: 829,625

[22] Filed: Jan. 31, 1992

Related U.S. Application Data

[63] Continuation of Ser. No. 390,819, Aug. 8, 1989, abandoned.

[51] Int. Cl.[5] ..... H04K 3/00

[52] U.S. Cl. ..... 455/1; 455/49.1; 455/59; 455/103; 375/38

[58] Field of Search ..... 455/1, 12.1, 49.1, 59, 455/61, 103, 104; 330/126; 375/38; 370/84; 371/68.2

[56] References Cited

U.S. PATENT DOCUMENTS 4,697,281 9/1987 O'Sullivan ..... 455/33.1
4,979,170 12/1990 Gilhousen et al. ..... 455/12

FOREIGN PATENT DOCUMENTS 580291 7/1933 Fed. Rep. of Germany ..... 455/103
629363 4/1936 Fed. Rep. of Germany ..... 455/103

OTHER PUBLICATIONS

Standing, "The UET Multitube Transmitter" Mar. 25, 1975, Comstat Tech. Review vol. 5, No. 2 pp. 355-365.

*Primary Examiner*—Reinhard J. Eisenzopf
*Assistant Examiner*—Edward Urban
*Attorney, Agent, or Firm*—Brown, Martin, Haller & McClain

[57] ABSTRACT

A modular data link having a transmit processor for receiving input data and for providing different portions of the input data at each of a plurality of outputs. A plurality of transmit channels each receive an input data portion and transmit a signal corresponding to the received input data portion. An antenna collects the transmitted signals and provides an output thereof. A plurality of received channels each receive the collected signals from the antenna and extract a different input data portion from the collected signals. A receive processor having a plurality of input each coupled to a respective receive channels receives the extracted different input data portions so as to recombine the different input data portions in regenerating said original input data as output data.

13 Claims, 2 Drawing Sheets

MULTIPLE ENCODED CARRIER DATA LINK

This is a Continuation of application Ser. No. 07/390,819, filed Aug. 8, 1989, now abandoned.

BACKGROUND OF THE INVENTION

I. Technical Field

The present invention relates to the transmission of data over a radio link. More specifically, the present invention relates to a novel data link having multiple parallel data paths which gives it many desirable features that are not present in data links of a conventional design.

II. Background of the Art

Data links encounter many difficulties when operating in hostile conditions such as those in a combat environment. A military data link that will be used in combat needs to be difficult to jam, reliable and have a reasonable price.

A common combat scenario in which data links are employed is one in which data is transmitted between an airborne terminal and a ground terminal in both directions. The airborne terminal has a number of sensors on board, for example, radar, infrared scanners radio receivers and TV, and the data from the sensors is transmitted to ground stations for use by the ground troops. The data link needs to operate in an environment that has jamming and multipath propagation. The data link also needs to be "fail soft" which means it has very few parts that if they failed they would cause the total disruption of the flow of data.

The conventional data links transmit all data on one carrier wave which makes them susceptible to jamming, fading due to multipath and total failures because most of the parts that make up the data link are single point failure parts.

Therefore, it is the object of the present invention to provide a modular data link that has many parallel paths for the data and a corresponding number of carriers so that the link is difficult to jam because if a jammer only jams a few of the carriers the data link can continue to operate. The parallel data paths also makes the link immune to multipath fading because not all carriers will fade simultaneously so that the data link can continue to operate. The parallel data paths also makes the link "fail soft" because a failure in one of the paths will not cause a total failure of the link.

SUMMARY OF THE INVENTION

The present invention relates to a data link design that is capable of exceptionally effective operation in a hostile environment. The present invention takes advantage of the state of the art of electronic fabrication techniques including monolithic analog integrated circuits.

An operating environment in accordance with the present invention is a communication system having an uplink and a downlink, each being the modular data link of the present invention. In such an environment, the downlink typically transmits data from an airborne terminal to a ground-based terminal, while the uplink typically transmits data from the ground-based terminal to the airborne terminal. However, either terminal may be located on an aircraft, a space vehicle, or the ground and may be moving or stationary with respect to the other terminal. In a downlink transmission, data to be transmitted by a downlink transmission system is first processed by a data processor. The data processor divides an incoming high rate data stream into parallel low-rate data streams. The processor encodes each divided data stream with forward error correction information. Each encoded data stream is provided to a separate one of a plurality of parallel transmit channels. Each transmit channel includes a very high frequency (VHF) radio, up-converter, amplifier and antenna. The data input to the VHF radios is used to modulate a frequency hopping carrier signal. The VHF radio outputs are frequency-hopping signals are in the VHF frequency band. Each VHF radio output is coupled to a separate up-converter for converting the VHF signal to a signal in the microwave frequency range. The up-converter outputs can be spread out to cover a wide microwave frequency band or all can operate in the same band with orthogonal hop sets. The output of each up-converter is provided through a power amplifier to a separate omnidirectional antenna for radiating the microwave signal.

In a downlink reception, a downlink reception system incorporates a directional high gain antenna for receiving signals radiated by the downlink transmission system. The downlink reception system uses an antenna tracking system in order to track the transmissions of the typically moving airborne downlink transmission system. The output of the downlink reception system antenna is split into a plurality of separate parallel receive channels, each corresponding to a separate one of the transmit channels. Each receive channel includes a down-converter and a VHF radio. Each down-converter converts the received signal from the microwave frequency range to VHF frequency range. The output of each down-converter is provided to a corresponding VHF radio. The VHF radios convert the VHF signals back to low rate data streams. The outputs of the VHF radios feed a data processor. The downlink receive system data processor provides error-correcting decoding of the data streams. In addition the processor combines the separate data streams to reconstruct the data stream output.

In this embodiment, the uplink operates identically to the downlink, except that the uplink transmit system is ground-based while the uplink receive system is airborne. However, embodiments are envisioned in which the modular data link of the present invention serves as either the downlink or uplink only, while a different data link serves as the counterpart.

BRIEF DESCRIPTION OF THE DRAWINGS

These and other features and advantages of the invention will become fully apparent from the detailed description set forth below when taken in conjunction with the drawing wherein.

DETAILED DESCRIPTION OF PREFERRED EMBODIMENTS

Structure and Function

Figure 1A:
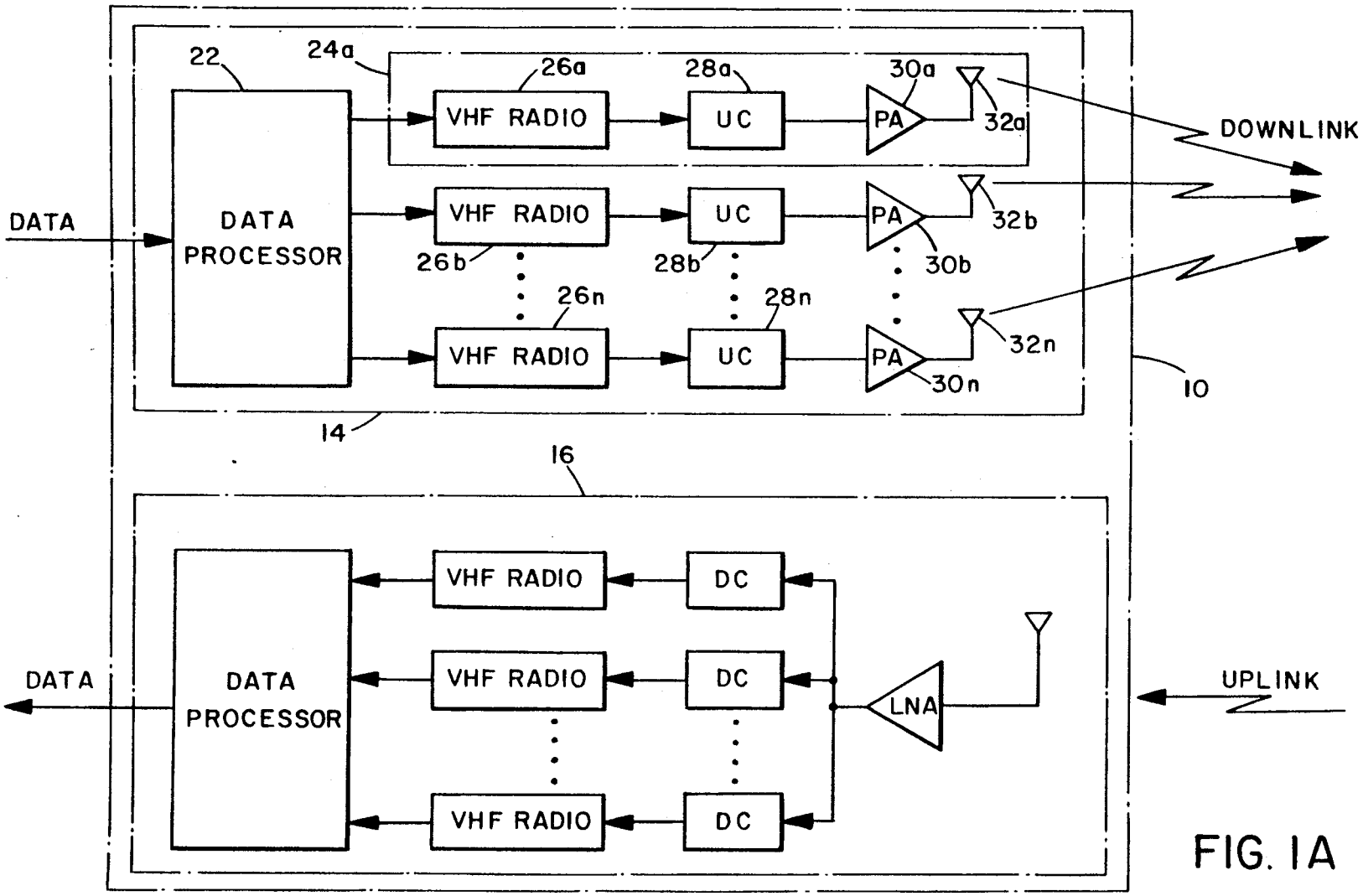
FIGS. 1A and 1B illustrate in block diagram form a communication system which modular data link of the present invention having downlink and uplink portions.
Figure 1B:
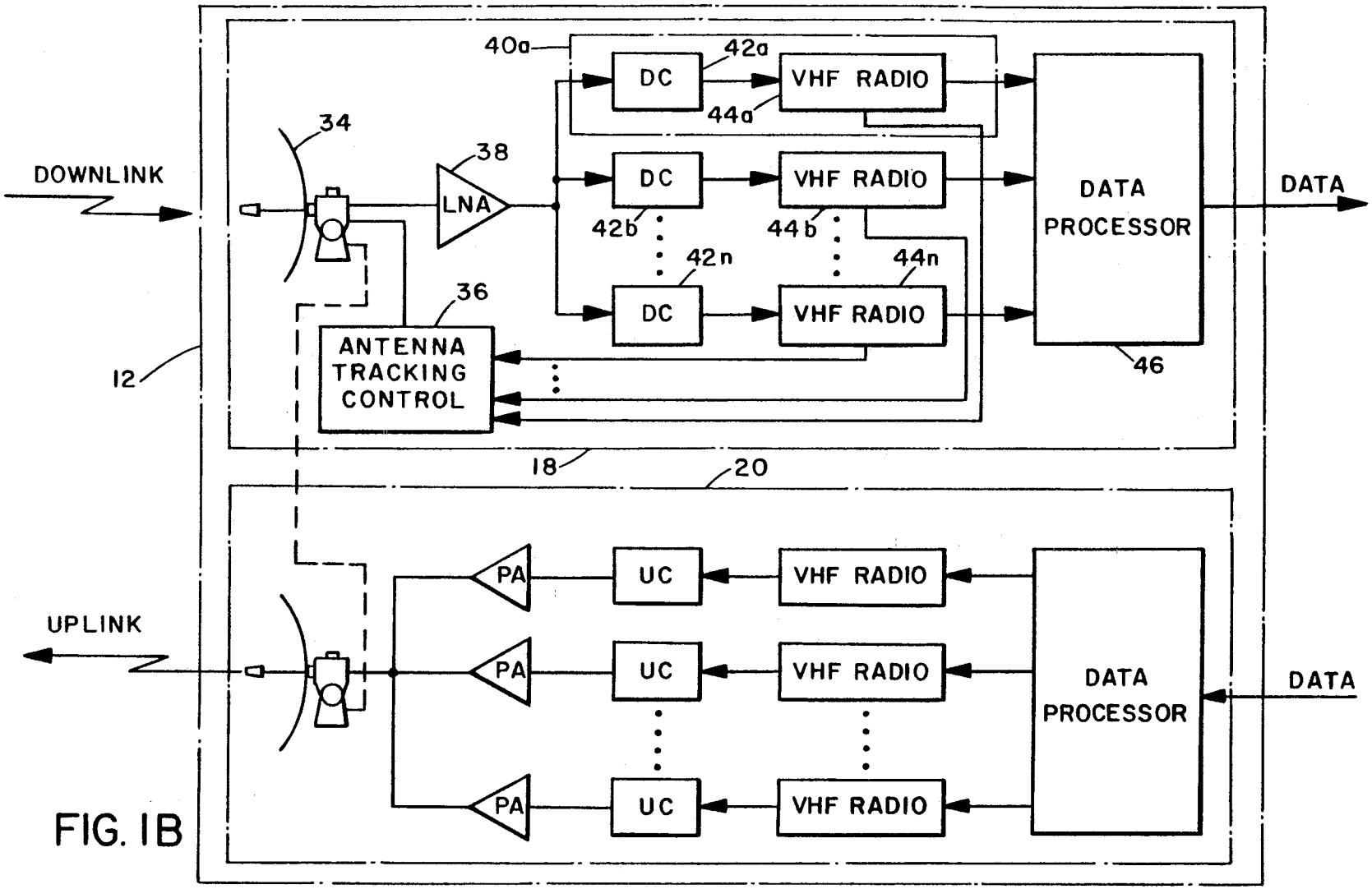

A communication system employing a preferred embodiment of the novel and improved data link of the present invention is illustrated in FIGS. 1A and 1B. This communication system comprises an uplink and a downlink allowing full duplex communications. In the full duplex configuration, the system comprises at least two communications terminals with each terminal having transmit and receive capabilities. FIG. 1 illustrates an exemplary embodiment in which an airborne communication terminal 10 communicates with one of many ground communication terminals 12. Terminal 10 comprises downlink transmit system 14 and uplink receive system 16 at a first location. Terminal 12 comprises downlink receive system 18 and uplink transmit system 20 at a second location. Downlink systems 14 and 18 unless otherwise noted are structurally and functionally identical to uplink systems 16 and 20.

A downlink transmission utilizes downlink transmit system 14 and downlink receive system 18. Downlink transmit system 14 includes data processor 22 for dividing an incoming high rate data stream into parallel lower rate transmit data streams, encoding the data in each low rate transmit data stream, and providing each encoded data stream to a different one of a plurality of outputs. The encoding is adaptable to the ratio of the incoming data rate to the number of parallel data streams and the rate of each stream.

Data processor 22 is coupled at its outputs to a plurality of separate downlink transmit paths 24*a*–24*n*. Processor 22 thus provides different portions of the high rate data stream. Each transmit path 24 is comprises of VHF radio 26, a frequency up-converter 28, a power amplifier 30 and an omnidirectional antenna 32.

Each VHF radio 26*a*–26*n* has an input coupled to a corresponding output of processor 22. VHF radios 26*a*–26*n* receive the low rate transmit data streams and modulate a carrier signal with the data. The VHF radios 26*a*–26*n* typically utilize a frequency hopping carrier signal in the Very High Frequency (VHF) range. The outputs of the VHF radios 26*a*–26*n* are frequency hopped signals within a 60 MHz band from about 30 MHz to about 90 MHz. VHF radios 26*a*–26*n* employed are typically the well known VHF Combat Net Radios.

Each up-converter 28*a*–28*n* is coupled to the output of a corresponding VHF radio 26*a*–26*n*. Up-converters 28*a*–28*n* convert the frequency hopped VHF signals to corresponding microwave signals. Each up-converter 28*a*–28*n* is set to convert the signals output from VHF radios 26*a*–26*n* to different frequency bands in the Ku-band. However using orthogonal codes in the hopping scheme would permit the same Ku frequency band to be used.

Each power amplifier 30*a*–30*n* is coupled to the output of a corresponding up-converter 28*a*–28*n*. Power amplifiers 30*a*–30*n* amplify the microwave frequency signals to levels appropriate for transmission.

Each antenna 32*a*–32*n* is an omni-directional antenna coupled to the output of a corresponding power amplifier 30*a*–30*n*. Antennas 32*a*–32*n* radiate the microwave transmission signals as provided from power amplifiers 30*a*–30*n*.

Downlink receive system 18 includes high-gain directional tracking antenna 34. Antenna 24 is for receiving microwave transmission signals radiated by the antenna 32*a*–32*n* Antenna 34 is responsive to control signals, provided by antenna tracking control systems 36, for mechanically changing its pointing direction.

Antenna tracking control system 36 is coupled to the input of antenna 34 and to an output of each of the receive paths as discussed hereinbelow in further detail. Antenna tracking control system 36 generates a beam control signal and an antenna pointing steering signal in response to a plurality of signals received from the receive paths. Antenna tracking control system 36 provides these control signals to antenna 34 for antenna pointing.

Low noise amplifier (LNA) 38 is coupled to the output of antenna 34. LNA 38 amplifies the received microwave signals. The output of LNA 38 is coupled to a plurality of separate receive paths 40*a*–40N.

Each receive path 40*a*–40*n* corresponds to a respective transmit path 24*a*–24*n* of downlink transmit system 14. Each receive path 40 is comprised of downconverter 42 and VHF radio 44.

Each down-converter 42*a*–42*n* is of coupled to the output of LNA 38. Down-converters 42*a*–42*n* convert the amplified incoming signals from the microwave frequency band to the VHF frequency band. Each down-converter 42*a*–42*n* converts a different 60 MHz microwave band down, when transmitted as such, to the originally corresponding VHF frequency band of a different one of the transmit paths 24*a*–24*n* of downlink transmit system 14.

Each VHF radio 44*a*–44*n* is coupled to the output of a corresponding down-converter 42*a*–42*n* demodulate and, VHF radios 44*a*–44*n* convert the VHF signals back to lower-rate receive data streams. At least one of VHF radios 44*a*–44*n* provides signals to Antenna tracking control system 36 from which the antenna control signals are generated. It is envisioned that one or all of the transmit and receive channels may be used for antenna steering purposes in one form or another.

Data processor 46 is coupled at each of a plurality of inputs to the output of a different one of VHF radios 44*a*–44*n*. Data processor 46 is for error correcting and decoding the individual parallel data streams Data processor 46 further combines the separate lower-rate streams into a single high rate data stream that corresponds to the data input to data processor 22.

As mentioned previously, terminal 10 further includes uplink receive system 16. Uplink receive system 16 is similar to downlink receive system 18 except that it uses an omnidirectional antenna rather than a directional antenna. With an omnidirectional antenna, uplink receive system 10 does not utilize an antenna tracking control system. As illustrated in FIG. 1A, the uplink receive system 16 antenna is a separate antenna from antennas 32*a*–32*n*.

Furthermore, terminal 12 includes uplink transmit system 20 as also mentioned previously. Uplink transmit system 20 is similar to downlink transmit system 14 except that a directional antenna is utilized rather than an omnidirectional antenna. As illustrated in FIG. 1B, uplink transmit system 20 antenna is a separate antenna from downlink receive antenna system 16 antenna 34, In this configuration the uplink transmit system 20 antenna receives control signals from antenna tracking control system 36. Typically antenna 34 is mechanically coupled to the uplink transmit system 20 antenna.

Theory of Operation

The present invention realizes many of its objectives as a result of the novel feature of multiple parallel transmit and receive channels. The present invention separates the high data rate data stream into multiple parallel lower-rate streams. Each lower-rate data stream is encoded to enable reconstruction of a segment of the high rate data stream. Each lower-rate data stream can be transmitted effectively with significantly less signal power than would be required to transmit the original high data rate data stream. For example, if a single path requires W watts for transmission, n paths will require W/n watts per path. As a result, the transmit paths do not require the power hungry, failure-prone, high-power components which a single channel data link requires. Rather the transmit paths of the present invention may be entirely solid state making them extremely reliable and power efficient.

In addition, the multiple path architecture of the data link of the present invention provides for soft failure rather than complete failure if a key component should fail.

In the conventional single-channel data link, if a component critical to the transmit or receive path fails, communications are completely halted. Whereas, in the present invention, if a component critical to a single path fails, communications will continue at a slightly lower rate utilizing the remaining paths.

Further, the multiple path design of the present invention provides exceptional electronic counter countermeasure facilities making the link very difficult to detect and jam. Because each of the channels transmit at low power levels, the transmissions are difficult to detect. Detection is also very difficult because each of the paths are hopping at random, therefore, signal sorting techniques will not be able to determine which of the hopping signals go with which of the data paths.

Jamming the data link of the present invention is extremely difficult because many independent channels are transmitted across a very broad frequency band. To completely halt transmission, a jammer must jam all channels simultaneously. This would require either a very high-power, broadband noise jammer, or many narrow band follower type jammers which must each jam a different channel.

The multiple-channel architecture of the data link of the present invention additionally provides exceptionally effective operation in a multipath environment. In a multipath environment, the transmission signal of a data link tends to fade as a result of the destructive interference of identical signals traversing paths from transmitter to receiver which have slightly different lengths. However, because the present invention provides a plurality of signals transmitted at different radio frequencies and therefore different wavelengths, fading will not occur simultaneously for each channel. If the multipath conditions are such that one channel has faded, it will be necessarily true that others will be received properly.

Since the present invention provides for proper reception of at least some of the parallel channels, communications will never fail as a result of fading. If the faded channels are virtually unreceivable, then communications can continue at a slightly lower rate on the active channels. Or, if some channels are partially faded, they may be processed with extra error correction to insure proper data recovery.

The data link of the present invention further provides better acquisition characteristics than those of a conventional single channel link. In a preferred embodiment of the present invention, one of the plurality of parallel transmit channels is dedicated to acquisition and remains in acquisition mode while the others transmit data. This allows a particular receiver to asynchronously acquire the signal while others are continuously receiving data. In addition, because each of the multiple channels is transmitting at a much lower data rate than would be required of a conventional single-channel data link, temporal acquisition may be accomplished relatively quickly with a receive clock of relatively low precision tolerance.

The multiple channel design of the present invention also provides for the acquisition of transmission signals having severe Doppler shift. Conventionally, if there is a radial velocity between the ends of the link, there can be enough Doppler to make acquisition difficult or impossible unless it is taken into account. For example, a radial speed of 260 m/sec (about 500 knots) gives 13 KHz of Doppler shift at Ku-band, and the typical radio has a bandwidth of about 20 KHz. However, the present invention allows the plurality of receive paths to be put in the acquisition mode and staggered in frequency to bracket all possible Doppler shifts. When an acquisition is made in any one or more of the receivers, the Doppler is estimated with data from the receiver with the least offset. Once the acquisition is made, the down-converters are switched so that data reception can start. Doppler tracking is then done with closed loop control with a signal derived from the receive VHF radios.

Thus, the novel multiple-path construction of the modular data link of the present invention provides for many features and advantages making it superior to the prior art. Further, the present invention incorporates a directional high-gain receive tracking antenna which provides additional advantages over the prior art. This feature of the present invention allows for effective data transmission with relatively low transmission signal power, because the directional antenna tracks the signal source with a high-gain narrow antenna beam. Also, the directional tracking antenna of the present invention makes jamming difficult, because the main lobe of the antenna beam is following the transmission source. Therefore, unless a jammer is directly between the directional antenna and the source its jamming signal will impinge on the antenna through a sidelobe, requiring much more power to jam effectively.

The previous descriptions of the preferred embodiments are provided to enable any persons skilled in the art to make or use the present invention. Various modifications to these embodiments will be readily apparent to those skilled in the art, and the generic principles defined herein may be applied other embodiments without the use of the inventive facility. Thus, the present invention is not intended to be limited to the embodiments shown herein, but is to be accorded the widest scope consistent with the principles and novel features enclosed herein.

I claim:

1. A data link having forward error correction for substantially error-free transmission of input data from one source to a target point, said data link comprising:

a transmit data processor means for receiving input data from said one source, for encoding said input data into a plurality of transmit data streams, and for providing one of said plurality of transmit data streams at each of a plurality of outputs said transmit data processor means comprising:

transmit radio means having an input coupled to a different processor output for receiving a corresponding transmit data stream, for generating a carrier signal having a frequency within a band of frequencies wherein each carrier signal varies in frequency within said band at random, independent of other carrier signals, and for modulating said carrier signal with said transmit data stream;

transmit antenna means for receiving and radiating said modulated carrier signal;

receive antenna means for collecting said transmission signals and for providing collected signals;

a plurality of receive means, each for receiving said collected signals and for extracting receive data streams from said collected signals, each of said receive data streams corresponding to one of said transmit data streams; and receive data processor means having a plurality of inputs, each of said inputs coupled to a respective said receive means, said inputs for receiving each of said receive data streams, said received data processor means for decoding and recombining said receive data streams so as to regenerate said original input data as output data to said target point.

2. The data link of claim 1 wherein each transmit means further comprises:

up-converter means disposed between said transmit radio means and said transmit antenna means for receiving and translating the frequency of said modulated carrier signal to a higher frequency; and amplifier means disposed between sand up-converter means and said transmit antenna means for receiving and amplifying said modulated carrier signal and for providing an amplified high frequency modulated carrier signal to said transmit antenna means.

3. The data link of claim 2 wherein each receive means comprises:

receive radio means for receiving said collected signals, for demodulating a predetermined one of said collected signals and for providing one of said receive data streams corresponding to one of said transmit data streams; and down-converter means disposed between said receive antenna means and said receive radio means for receiving said collected signals and translating the frequency of said collected signals to a lower frequency.

4. The data link of claim 1 further comprising amplifier means disposed between said receive antenna means and said plurality of receive means for amplifying said collected signals.

5. The data link of claim 2 wherein each receive means comprises:

receive radio means for receiving said collected signals, for demodulating a predetermined one of said collected signals and for providing one of said receive data streams corresponding to one of said transmit data streams.

6. The data link of claim 3 further comprising amplifier means disposed between said receive antenna means and each of said down-converter means for amplifying said collected signals.

7. A communications system having an up-link and down-link, each being a data link having forward error correction for substantially error-free and jam-resistant transmission of data from one first point to a second point, said communications system comprising:

a transmit data processor means for receiving input data from said first point, for encoding said input data into a plurality of transmit data streams, and for providing one of said transmit data streams at each of a plurality of outputs;

a plurality of transmit radio means, each for receiving one of said transmit data streams for converting said transmit data streams to converted transmit data streams having a form suitable for transmission, each said transmit radio means being coupled to a different transmit data processor output for receiving a corresponding transmit data stream, for generating a carrier signal which varies in frequency within a band of frequencies at random, independent of carrier signals of other transmit radio means, and for modulating said carrier signal with said transmit data stream, providing a modulated carrier signal;

transmit antenna means for receiving and radiating transmission signals corresponding to said converted transmit data streams;

receive antenna means for collecting said transmission signals and for providing collected signals;

a plurality of receive means each for receiving said collected signals and for extracting a receive data stream from said collected signals corresponding to one of said transmit data streams; and receive data processor means having a plurality of inputs each coupled to a respective receive means for receiving each of said receive data streams, said receive data processor means for recombining said receive data streams so as to regenerate said original input data as output data;

wherein said up-link is for transmitting data in a first direction from said first point to said second point, and said down-link is for transmitting data in a second direction opposite to said first direction.

8. The data link of claim 7 wherein each transmit means further comprises:

up-converter means disposed between said transmit radio means and said transmit antenna means for receiving and translating the frequency of said modulated carrier signal to a higher frequency; and amplifier means disposed between said up-converter means and said transmit antenna means for receiving and amplifying said modulated carrier signal and for providing an amplified high frequency modulated carrier signal to said transmit antenna means.

9. The data link of claim 7 wherein each receive means comprises:

receive radio means for receiving said collected signals, for demodulating a predetermined one of said collected signals and for providing one of said receive data streams corresponding to one of said transmit data streams.

10. The data link of claim 7 wherein each receive means comprises:

receive radio means for receiving said collected signals, for demodulating a predetermined one of said collected signals and for providing one of said receive data streams corresponding to one of said transmit data streams; and down-converter means disposed between said receive antenna means and said receive radio means for receiving said collected signals and translating the frequency of said collected signals to a lower frequency.

11. The data link of claim 10 further comprising amplifier means disposed between said receive antenna means and each of said down-converter means for amplifying said collected signals.

12. The data link of claim 7 wherein:

said transmit antenna means of said downlink comprising a plurality of omnidirectional antennas each coupled to a respective transmit means of said downlink; and said receive antenna means of said downlink comprises a directional antenna coupled to respective receive means of said downlink.

13. The data link of claim 7 wherein:

said transmit antenna means of said uplink comprises a directional antenna coupled to said transmit means of said uplink; and said receive antenna means of said uplink comprises an omnidirectional antenna coupled to said receive means of said uplink.

* * * * *